US011145477B2

(12) United States Patent
Ehrhardt et al.

(10) Patent No.: US 11,145,477 B2
(45) Date of Patent: Oct. 12, 2021

(54) SHORT-CIRCUITING DEVICE FOR USE IN LOW-VOLTAGE AND MEDIUM-VOLTAGE SYSTEMS FOR THE PROTECTION OF PROPERTY AND PERSONS

(71) Applicant: DEHN SE + CO KG, Neumarkt/Opf. (DE)

(72) Inventors: Arnd Ehrhardt, Neumarkt (DE); Klaus Bühler, Eckental (DE)

(73) Assignee: DEHN SE + CO KG, Neumarkt/Opf. (DE)

( * ) Notice: Subject to any disclaimer, the term of this patent is extended or adjusted under 35 U.S.C. 154(b) by 0 days.

(21) Appl. No.: 16/957,825

(22) PCT Filed: Dec. 3, 2018

(86) PCT No.: PCT/EP2018/083269
§ 371 (c)(1),
(2) Date: Jun. 25, 2020

(87) PCT Pub. No.: WO2019/134777
PCT Pub. Date: Jul. 11, 2019

(65) Prior Publication Data

US 2021/0066009 A1 Mar. 4, 2021

(30) Foreign Application Priority Data

Jan. 3, 2018 (DE) ..... 102018100076.6

(51) Int. Cl.
*H01H 39/00* (2006.01)
*H01H 37/76* (2006.01)

(52) U.S. Cl.
CPC ..... *H01H 37/765* (2013.01); *H01H 37/761* (2013.01); *H01H 39/004* (2013.01); *H01H 39/00* (2013.01)

(58) Field of Classification Search
CPC .... H01H 37/761; H01H 37/765; H01H 39/00; H01H 39/004; H01H 39/006; H01H 2039/008
See application file for complete search history.

(56) References Cited

U.S. PATENT DOCUMENTS 4,150,266 A * 4/1979 Patrichi ..... H01H 39/004 102/202.14
2003/0231439 A1* 12/2003 Juds ..... H01H 79/00 361/2

(Continued)

FOREIGN PATENT DOCUMENTS

DE 9419141 U1 3/1996 ..... H01H 79/00
DE 102005048003 A1 4/2007 ..... H01H 79/00

(Continued)

OTHER PUBLICATIONS

An Office Action (in German), dated Sep. 5, 2018, issued by the German Patent Office for Applicant's corresponding German Patent Application No. DE102018100076.6, filed Jan. 3, 2018.

(Continued)

*Primary Examiner* — Jacob R Crum
(74) *Attorney, Agent, or Firm* — Bodner & O'Rourke, LLP; Gerald T. Bodner; Christian P. Bodner

(57) ABSTRACT

The invention relates to a short-circuiting device for use in low-voltage and medium-voltage systems for the protection of property and persons, comprising: a switching element, which can be operated by the tripping signal of a fault detection device; two mutually opposite contact electrodes having power supply means, which contact electrodes can be brought into contact with an electrical circuit having connection points at different potential; furthermore, in at least one of the contact electrodes, a movable contact part, which is under mechanical preload and executes a move- (Continued)

Figure 1:
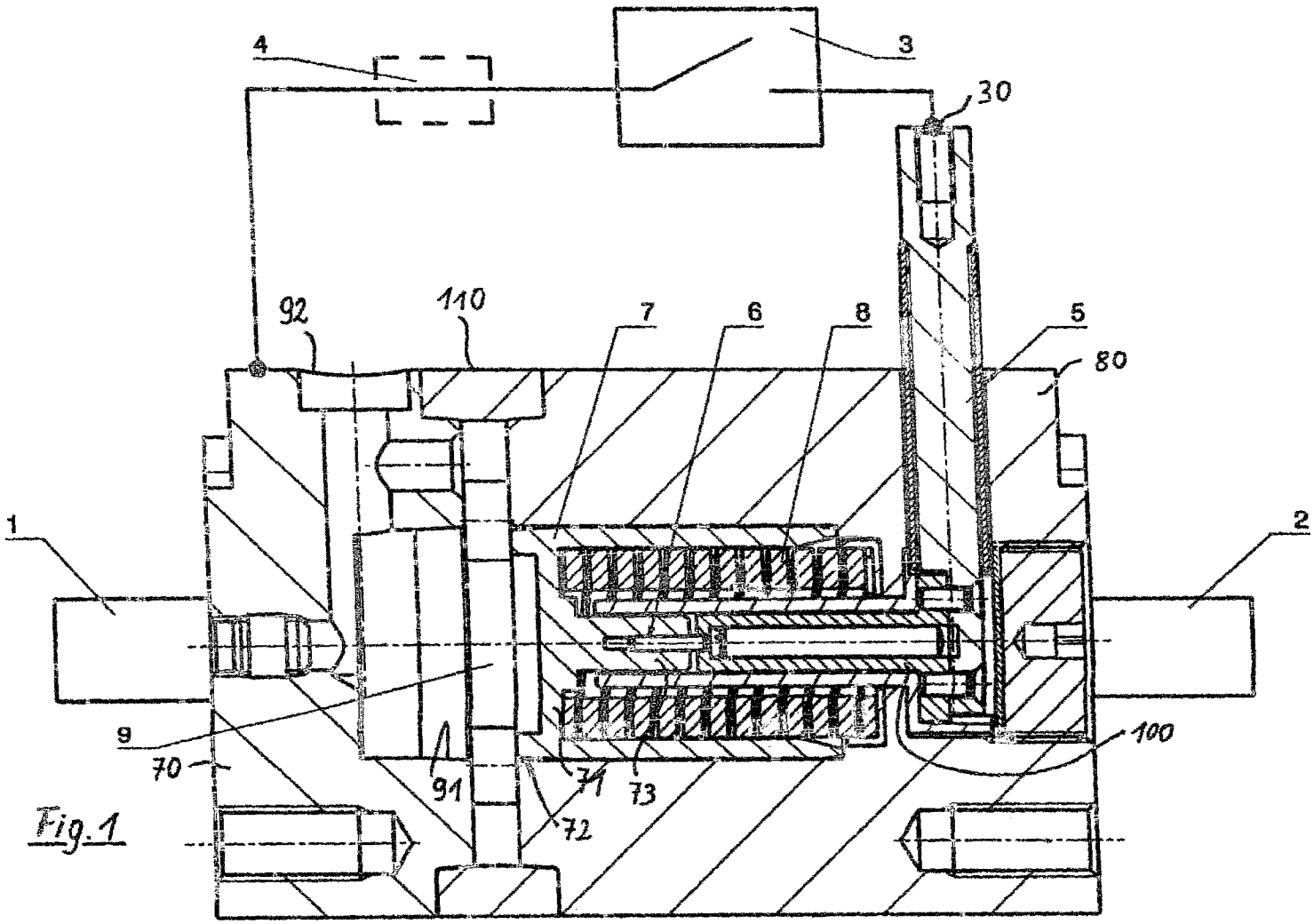

ment to the further contact electrode with the assistance of spring force in the event of a short circuit; and a sacrificial element as a spacer between the contact electrodes, with an electrical connection between the sacrificial element and the switching element on the one hand and one of the contact electrodes on the other hand, in order to deliberately cause current-flow-induced thermal deformation or destruction of the sacrificial element. According to the invention, the movable contact part is in the form of a hollow cylinder which is closed on one side, and a spring for generating preload is inserted in the hollow cylinder. The hollow cylinder is movably guided in a complementary cutout in the first contact electrode, a sliding contact thus being formed. In the region of the base of the closed hollow cylinder, the cylinder wall of said hollow cylinder transitions into a cone at the outer circumference. Furthermore, a first pin-like extension, opposite to which a second pin-like extension insulated from the contact electrodes is situated, extends within the hollow cylinder, proceeding from the base. The sacrificial element, in the form of a bolt or screw, is arranged between the first and the second pin-like extension. A cutout, which has an internal cone and is matched to the external cone of the movable contact, is provided in the second contact electrode. The external cone and the internal cone form a bounce-free short-circuit contact region having frictional locking and interlocking connection on account of plastic deformation which occurs. Furthermore, according to the invention the switching element is designed as an auxiliary short-circuiter on the basis of an electric match.

18 Claims, 4 Drawing Sheets

(56) References Cited

U.S. PATENT DOCUMENTS

2003/0231443 A1* 12/2003 Shea ..... H01H 39/004 361/42
2003/0231452 A1* 12/2003 Hetzmannseder ..... H01H 79/00 361/120
2012/0050936 A1* 3/2012 Douglass ..... H01C 7/12 361/111
2013/0033796 A1* 2/2013 Shea ..... H01H 39/004 361/126
2017/0229267 A1* 8/2017 Lell ..... H01H 3/28

FOREIGN PATENT DOCUMENTS

DE 102005048003 B4 4/2008 ..... H01H 37/76
DE 202006020737 U1 9/2009 ..... H01H 79/00
DE 202012001729 U1 4/2012 ..... H01H 9/56
DE 102014016274 A1 3/2016 ..... H01H 79/00
WO WO2007014816 A1 2/2007 ..... H01H 79/00

OTHER PUBLICATIONS

The Notification Concerning Transmittal of International Preliminary Report on Patentability (Chapter I of the Patent Cooperation Treaty), in English, dated Jul. 16, 2020, which was issued by the International Bureau of WIPO in Applicant's corresponding international PCT application having Serial No. PCT/EP2018/083269, filed on Dec. 3, 2018.

The English translation of the International Preliminary Report on Patentability (Chapter I of the Patent Cooperation Treaty), dated Jul. 7, 2020, which was issued by the International Bureau of WIPO in Applicant's corresponding international PCT application having Serial No. PCT/EP2018/083269, filed on Dec. 3, 2018.

The Written Opinion of the International Searching Authority, in English, dated Feb. 26, 2019, which was issued by the International Bureau of WIPO in Applicant's corresponding international PCT application having Serial No. PCT/EP2018/083269, filed on Dec. 3, 2018.

The International Search Report, in English, dated Feb. 26, 2019, which was issued by the International Bureau of WIPO in Applicant's corresponding international PCT application having Serial No. PCT/EP2018/083269, filed on Dec. 3, 2018.

* cited by examiner

SHORT-CIRCUITING DEVICE FOR USE IN LOW-VOLTAGE AND MEDIUM-VOLTAGE SYSTEMS FOR THE PROTECTION OF PROPERTY AND PERSONS

The invention is based on a short-circuiting device for use in low-voltage and medium-voltage systems for the protection of property and persons, comprising a switching element, which can be operated by the tripping signal of a fault detection device, two mutually opposite contact electrodes having power supply means, which contact electrodes can be brought into contact with an electrical circuit having connection points at different potential, furthermore, in at least one of the contact electrodes, a movable contact part, which is under mechanical preload and executes a movement to the further contact electrode with the assistance of spring force in the event of a short circuit, and a sacrificial element as a spacer between the contact electrodes, with an electrical connection between the sacrificial element and the switching element on the one hand and one of the contact electrodes on the other hand, in order to deliberately cause current-flow-induced thermal deformation or destruction of the sacrificial element, according to the preamble of claim 1.

From DE 10 2005 048 003 B4, a short-circuiting device of the generic kind is already known. According to the teaching therein, the sacrificial element is a thin-walled hollow cylinder with a ratio between the diameter and wall thickness of the hollow cylinder of more than 10:1, wherein the sacrificial element consists of a high-melting metallic material. The relevant short-circuiting device is intended to have minimum commutation time at simultaneously high mechanical strength for using high spring force with the aim of reducing the movement time and for the purpose of faster response.

In a variant of the teaching of the state of the art, an insulating body and an auxiliary electrode are located in the fixed contact electrode, wherein the auxiliary electrode is in connection with the sacrificial element. The mutually opposite sides of the contact electrodes or the mutually opposite surfaces can have a complementarily conical shape with a resulting centering effect when coming into contact in the event of a short circuit.

Due to defined structures or wall thickness variations in the hollow cylinder, current paths may develop with the consequence of a non-uniform heating at current load and a deformation along with the loss of the mechanical strength. In this case, the conductive connection between the contact electrodes is maintained, but the mechanical resistance of the hollow cylinder is reduced so that under the effect of the spring force, the short-circuiting device can be brought rapidly in the desired closing state.

In the closed state, an effective ventilation channel or a ventilation bore can be effective between the contact electrodes in order to prevent forces from developing due to a pressure increase in the event of a short-circuit, in particular when an arc is generated, which forces counteract the movement of the contact electrodes toward each other in a closing time-delaying manner. According to the state of the art, the device for generating the preload force may be designed as a compression spring, disc spring or similar spring arrangement.

In a second embodiment according to DE 10 2005 048 003 B4, the sacrificial element may be a wire or rod of a conductive material having a low melting integral, wherein the sacrificial element is under mechanical prestress under tension.

Short-circuiting devices for the protection of installations generally have the task of realizing a metallic short circuit in a very rapid manner so that very high currents can be carried for a short time. During the rapid closing of metallic contacts, contact bouncing is difficult to be avoided. Due to bouncing, but also with a view to the magnitude of the flowing current, arcs may develop between the contacts, which heavily damage the surface of the contacts, whereby a safe conductance of the current over a longer period of time is at risk. In order to compensate the aforementioned negative phenomena, an increased effort in respect of construction and manufacture is required. This higher effort concerns the system for moving a corresponding contact part, on the one hand, but also the contacts themselves on the other hand.

From DE 10 2014 016 274 A1, a short-circuiting device especially for arc fault protection in low-voltage and medium-voltage systems is already known. The relevant short-circuiting device is intended to enable a full current carrying capacity over a longer period of time, on the one hand, and to have a status display. The short-circuiting device includes two mutually opposite contact electrodes, wherein in one of the contact electrodes, a movable contact part which is under mechanical preload and executes a movement toward the further contact electrode assisted by spring force in the event of a short circuit, as well as a sacrificial element are provided. Additionally, in the head part of a multi-part housing which accommodates the fixed and the movable contact electrode, a locking arrangement is formed preventing the movable electrode from retracting after the sacrificial element has been activated. In this respect, the movable electrode is blocked directly, or a slide following the movement of the movable electrode id blocked indirectly, by a spring-loaded bolt.

It is therefore a task of the invention to propose a further developed short-circuiting device for use in low-voltage and medium-voltage systems for the protection of property and persons, which has a compact structure and a simultaneously high current carrying capacity and furthermore enables extraordinarily short closing times to be met.

The solution of the task of the invention is performed according to the feature combination of claim 1, with the dependent claims comprising at least appropriate configurations and further developments.

The teaching falls back to the basic idea of realizing a bouncing-reduced contact system relating to a plastic deformation of a part of the mutually opposite contacts.

In the bounding-reduced contact system, the movable contact part will be provided with a relatively long, flat-angled conical contact area and preferably equipped with a spring drive quasi as a hollow-cylindrical contact. In the open state, the movement of the movable contact part is blocked.

When the short-circuiting device is correspondingly activated, the preload force, in particular the spring force, is released and assisted by at least one further force component which accelerates the closing movement.

The movable contact part is located in a fixed contact electrode having the same potential, and in the released state has a very long, preferably coaxial sliding contact without any additional spring contacts or the like. The sliding contact has a clearance dimension of $\leq 1/10$ mm.

With regard to the fixed contact electrode, the movement energy of the movable contact part is converted into a plastic deformation, which allows contact-bouncing and a disadvantageous arc phase to be avoided.

In the relevant embodiment of the invention, the movable contact part is formed as a hollow cylinder closed on one side. In the hollow cylinder, a spring is located for generating a preload. This spring may be inserted very simply into the space of the hollow cylinder, so that an additional constructional space for the spring is omitted.

The hollow cylinder is guided to be movable in a complementary recess in the first contact electrode while forming a sliding contact. Thus, the hollow cylinder is moveable like a piston in this recess.

In the area of the bottom of the closed hollow cylinder, its cylinder wall is configured to merge into an outer cone on the side of the outer circumference.

Furthermore, a first pin-shaped extension extends from the hollow cylinder bottom in the interior of the hollow cylinder, to which extension a second pin-shaped extension insulated from the contact electrodes is opposite.

Between the first and the second pin-shaped extension, the already mentioned sacrificial element is located.

The sacrificial element preferably is realized as a bolt or screw having a corresponding thread. The respective ends of the bolt or screw are fixed to the first and second pin-shaped extension via the thread or the screw head.

Furthermore, within the second contact electrode, a recess with an inner cone is provided, which recess is adapted to the outer cone of the movable contact part.

The outer and inner cone form a bounce-free short circuit contact area having a force and form fit due to plastic deformation occurring.

In a configuring manner, deaeration openings are provided in the area of the recess and connected to the inner cone. These deaeration openings are located in the second contact electrode in order to prevent pressure from building up due to the movement of the movable contact part.

These deaeration openings can be closed by a plug displacing under the effect of pressure. Similarly, a valve-like closure may be provided so that the penetration of humidity, dirt or other foreign matters can be avoided, but the mentioned undesired pressure build-up can otherwise be excluded.

The respective cone angle for forming the bounce-free, plastically deformable contact is in the range of ≤3°.

The contact electrodes and thus the basic construction of the short-circuiting device is preferably formed to be rotationally symmetrical. The contact electrodes are in this case kept at a distance via an insulating centering ring. The entire arrangement is encircled by an enclosing sheathing.

As already mentioned, the movable contact part is able to move like a piston in the recess of the first contact electrode, with the energy released during the destruction of the sacrificial element and/or the energy of a developing arc acting upon the bottom of the movable contact in a movement accelerating manner and results in the closing time to be shortened.

In an embodiment of the invention, the second pin-shaped extension is surrounded by an insulating tube of gas emitting material.

The insulating tube may be provided with a protecting metallic sheathing surrounding the insulating tube at least in part.

For triggering the short-circuiting device according to the present invention, contrary to the potential use of semiconductor switches, a novel switching element formed as a bridge igniter is used. This novel auxiliary short-circuiting device has a high switching speed that is comparable to a semiconductor switch, and a limited current carrying capacity adapted to the sacrificial element and the closing of the main contacts of the main short-circuiting device.

A bridge igniter has a safety wire, which is caused to be activated by a current flow of low level at low voltage. Bridge igniters are usually used for igniting reactive masses. Without the use of such reactive masses, they do not have any explosive power and do not require any restrictions as to handling and storage. Due to the lacking explosive power, such bridge igniters cannot carry out any considerable work, whereby their use as a short-circuiting device with considerable current carrying capacity is not given.

In the inventive teaching, however, the bridge igniter is utilized to trigger an auxiliary short-circuiting device, which directly activates the auxiliary path for loading the sacrificial element for the short-circuiting device described here.

The auxiliary path can in this case be closed within about 100 ms, so that disadvantages with respect to the speed of the switching processes in semiconductor switches will not occur. The auxiliary short-circuiting device utilizes the gas expansion directly or indirectly, which develops during the evaporation of the melting conductor of the igniter, to destroy a film, in particular an insulating film on a potential-loaded mandrel. After the destruction of the insulating film, current flows via the electrodes and contacts of the auxiliary short-circuiting device with or without the development of an arc, which serves the purpose of triggering the sacrificial element, which closes the main short-circuiting device having current carrying capacity with the assistance of spring force.

The switching element according to the invention, formed as a bridge igniter, is composed of two mutually opposite contacts having current carrying capacity, which are kept at a small clearance of ≤1 mm by an insulation, wherein the electrical insulation between the contacts is cancelled when the bridge igniter is triggered.

In a first embodiment of the invention, one of the contacts having current carrying capacity includes a depression in which a mandrel extension is formed whose tip points toward a film spanning the depression.

A further one of the contacts having current carrying capacity includes a cavity for accommodating the bridge igniter.

A pressure-tight sleeve is located in the cavity.

In a first variant of the switching device according to the invention, the sleeve includes a cap in the direction of the mandrel extension, which cap, when the bridge igniter is triggered, moves toward the mandrel extension while destroying the film and establishing an electrical connection between the contacts having current carrying capacity. To this end, the depression may have a deaeration opening.

In a second variant of the switching device according to the invention on the basis of a bridge igniter, conductive particles are present in the cavity, which, when the bridge igniter is triggered, establish an electrical connection between the contacts having current carrying capacity.

The conductive particles may be fixed by means of a film or a cover layer.

The switching element according to the invention may be arranged outside the actual main short-circuiting device but may also be integrated in it, in particular in a contact electrode, in particular be screwed in or plugged in there.

The invention will be explained in more detail below on the basis of an exemplary embodiment and with reference to Figures.

Figure 2:
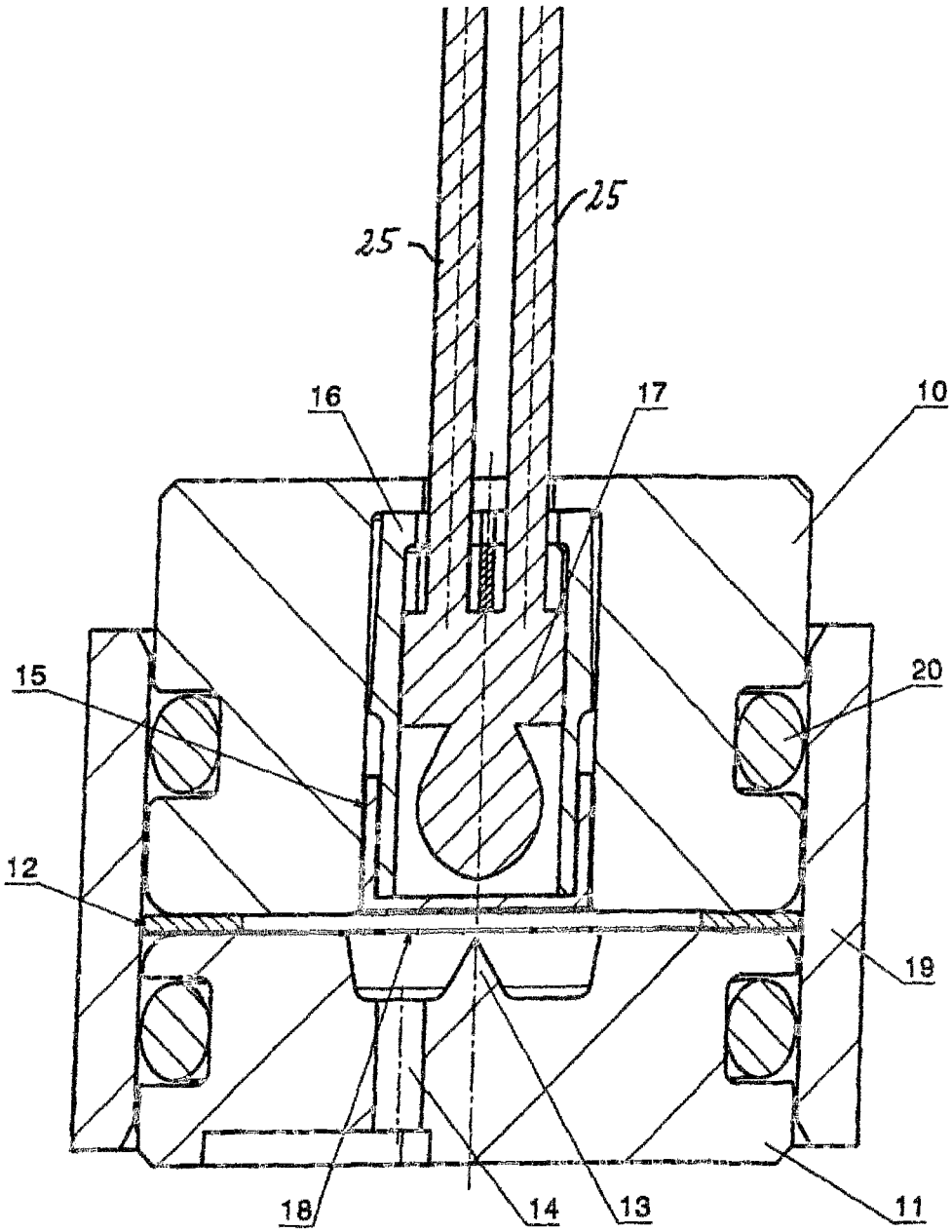
Figure 3:
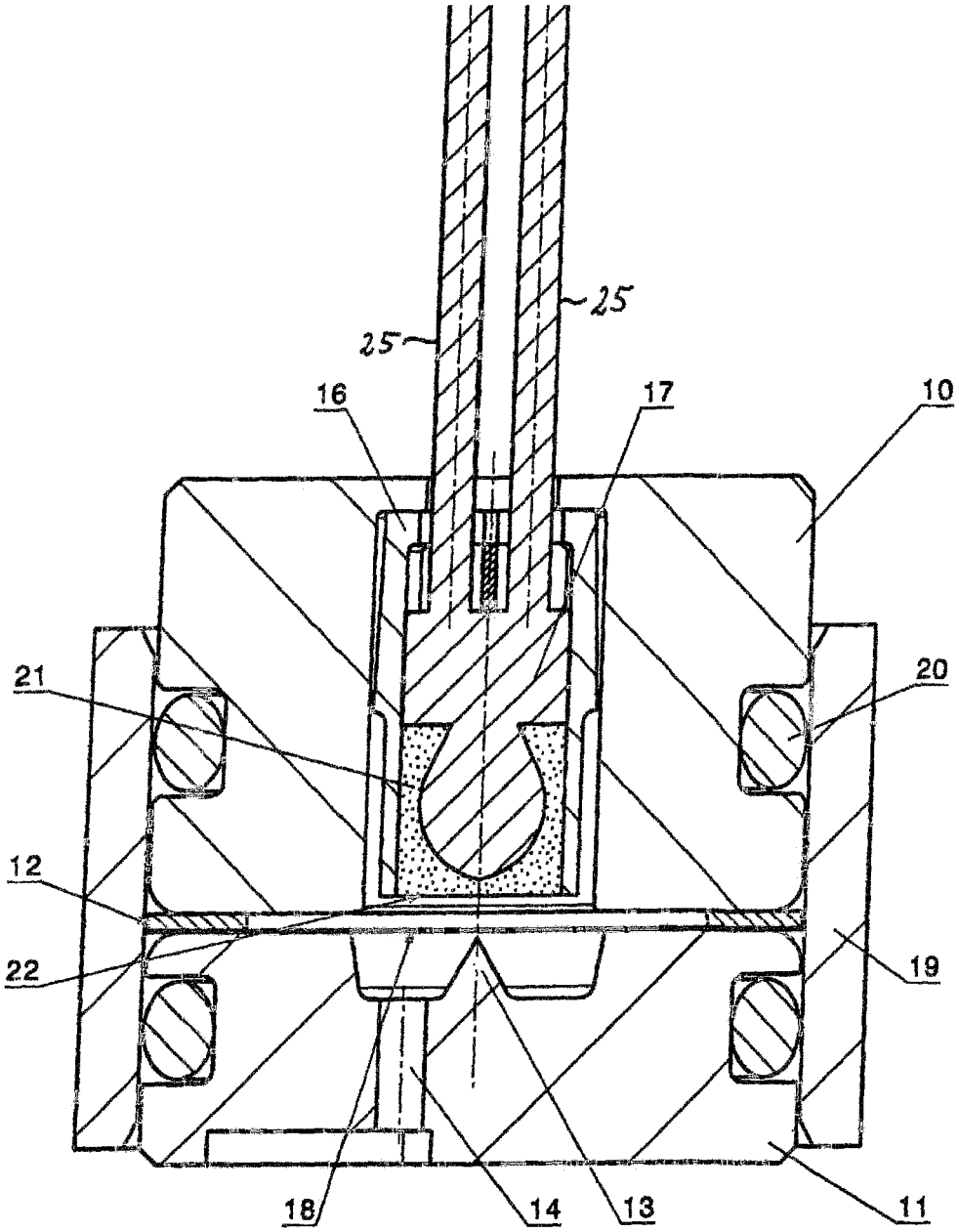
Figure 4:
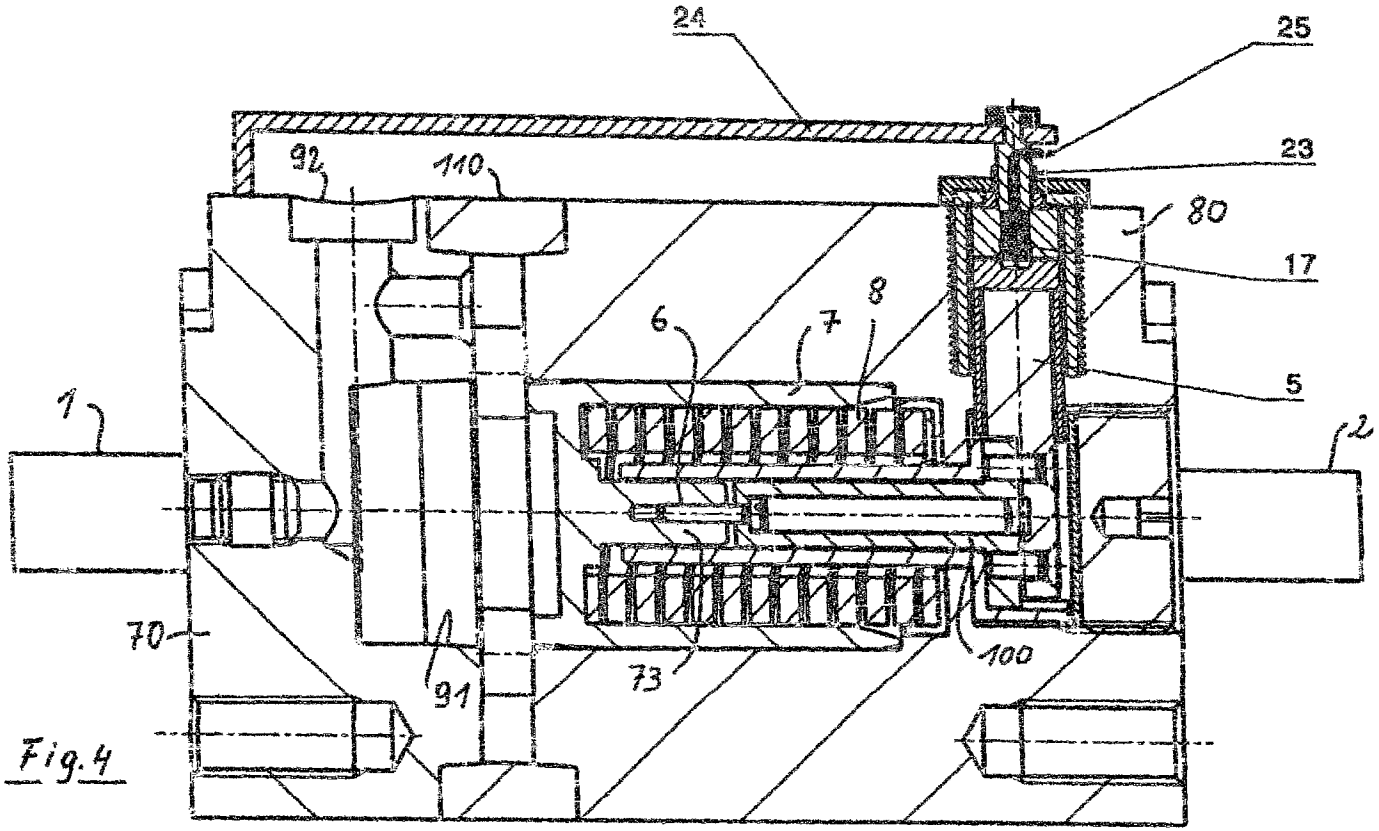

Shown are in:

FIG. 1 a longitudinal section representation through a short-circuiting device with a movable contact part formed as a hollow cylinder closed on one side, wherein a spring for producing a preload is inserted into the hollow cylinder, as well as with a sacrificial element in the non-triggered state;

FIG. 2 a sectional view through the switching element according to the invention, formed as a bridge igniter with two mutually opposite electrodes having current carrying capacity, which are kept at a short distance by an insulation, in one embodiment having a movable conductive cap for bridging the insulation along with a visible mandrel extension in the shown example formed within a depression within the lower contact having current carrying capacity;

FIG. 3 a view similar to that of FIG. 2 but including a formation of the switching element on the basis of a bridge igniter without a movable conductive cap, but with conductive particles present in the cavity of a visible sleeve, which are suitable for establishing an electrical connection between the contacts having current carrying capacity after the bridge igniter has been triggered; and FIG. 4 a representation similar to that of FIG. 1 with a main short-circuiting device in a longitudinal section, and a formation of the switching element according to the invention on the basis of a bridge igniter integrated into one of the contact electrodes.

According to the representation of FIGS. 1 and 4, a substantially cylindrical, rotationally symmetrical short-circuiting device is taken as a basis, which, at its front sides, includes connection options 1; 2 for contacting to busbars or additional parts.

Apart from these connections 1; 2 having high current carrying capacity, the short-circuiting device includes at least one further connection 30 that is introduced in an insulated manner, via which the activation of the short-circuiting device may be performed by means of a switching element 3 to which a fuse 4 is connected in series, if appropriate.

The short-circuiting device has a sacrificial element formed in the shown example as a screw or bolt 6.

The sacrificial element or the screw or bolt 6 mechanically fixes a movable contact part 7, which is mechanically preloaded via a spring 8.

The sacrificial element 6 is electrically connected to the exterior connection 30 via the movable contact part 7 with the contact electrode 80 and the exterior connection 2.

The second contact electrode 70 is connected to the connection 1 and electrically separated from the first contact electrode 80 via an insulated centering member 110.

The insulated centering member 110 guides the contact electrodes 70; 80, wherein the assembly of the aforementioned parts preferably may be realized by a press fit, in particular a taper interference fit.

Via the guidance in the contact electrode 80, the movable contact part 7 is centered with respect to the contact electrode 70.

Additionally, the arrangement of the aforementioned parts after the assembly is connected and fixed by an insulating frictional connection, for instance by a screwing or by a positive connection, for example by potting, which is not shown in detail in the Figures.

According to the shown realization variant, the triggering of the short-circuiting device is performed by a current flow across the sacrificial element 6 after the switching element 3 establishes a joint to the connection 1.

As a result of the current flow realized then across the sacrificial element 6, the sacrificial element 6 is heated and the mechanical fixing of the movable contact part 7 is cancelled.

Under the influence of the force of the spring 8, the movable contact part 7 is moved up to the contact electrode 70, whereby the main current path between the contact electrodes 70 and 80 is closed by the movable contact part 7.

In addition to the force of the spring, current forces act also and assist the closing movement. This is achieved by the central conduction of the current via the sacrificial element 6 and the substantially forced radial current conductance via the bottom of the movable contact part 7.

Hereby, a current loop arises, the resulting force action of which assist the spring force until the contacts between the movable contact parts and the contact electrode are closed.

The sacrificial element is not required to melt completely for triggering the closing process. It is decisive that the material of the sacrificial element is softened. This softening may also occur below the melting temperature.

In the area of the bottom 71 of the closed hollow cylinder, its cylinder wall merges into a cone 72 on the outer circumference side. Inside the hollow cylinder, a first mandrel-shaped extension 73 extends from the bottom, to which a second mandrel-shaped extension 100 insulated toward the contact electrodes 70, 80 is opposite, wherein between the first and the second mandrel-shaped extensions 73; 100 the already mentioned sacrificial element 6, in particular formed as a bolt or screw, is arranged.

In the second contact electrode 80, a recess adapted to the outer cone 72 of the movable contact 7 and with an inner cone 91 is provided, wherein the outer and inner cones form a bounce-free short circuit contact area with frictional and positive connection due to the occurring plastic deformation.

Furthermore, deaeration openings 92 may be provided in the second contact electrode 70 that are connected to the area of the recess with the inner cone, so as to prevent pressure from building up as a result of the movement of the contact part 7.

The deaeration openings 92 may be closed by a plug displacing under the effect of pressure, or by a valve.

The clearance dimension of the mentioned sliding contact is in a range of ≤0.2 mm, preferably ≤0.1 mm.

An exemplary configuration of the movable contact part 7 having a weight of substantially 100 g, an outer diameter of about 30 mm, at a spring force of about 800 N and a comparably short travel distance of the contact part 7, results in a kinetic energy of a couple of Joules, which is transferred to a large extent into plastic deformations in the contact area.

In case of a cone having a cone angle of <3° and a cone length of, for example, 6 mm to the contact electrode, this energy already leads to a extension of the theoretical travel distance when a simple positive connection of several 100 μm is adopted. In the preferred embodiment of the short-circuiting device for short circuit currents of several 10 to 100 kA, the energy available for the plastic deformation exclusively caused by the spring force, is at least 10 Joules. Due to the assistance of the spring force by additional forces in accordance with the implementation of the teaching according to the invention, extensions of the travel distance of >0.5 mm to 2 mm are achieved when the current has been interrupted after melting of the sacrificial element.

Without interruption of the current, the kinetic energy is increased to several 10 Joules, whereby the travel distance is extended by several millimeters as compared to a pure positive connection. In such an implementation, the travel distance may be limited by appropriate means, since for an adequate current carrying capacity according to the shown representations, only a small penetration depth of the contact part 7 with regard to the corresponding contact electrode is sufficient.

For further details with respect to the structure of the short-circuiting device, reference is made to DE 10 2016 115 222.6, which, concerning this matter, is declared in its entirety to be the subject matter of the present application.

The bridge igniter according to the invention will be explained in more detail by means of FIGS. 2 and 3 and relevant exemplary embodiments.

The fast switch 3 according to the representation of FIG. 1 is realized on the basis of a bridge igniter.

In the implementation according to FIG. 2, the switching element 3 includes two contacts 10 and 11 having current carrying capacity, which are kept at a short distance of ≤1 mm, for example, by an insulating disc 12.

In this case, there is the possibility for one of the contacts to possibly be under the effect of a spring preload force (not depicted figuratively).

In the contact 11 having current carrying capacity (the lower contact in the Figures), a depression is provided, which has a mandrel extension 13 and preferably a deaeration opening 14.

The opposite contact 10 has a cavity into which a movable contact 15 in the form of a cap is inserted.

This movable contact cap 15 is guided on a pressure-tight cylindrical sleeve 16.

Within the pressure-tight cylindrical sleeve 16, the actual bridge igniter 17 is located.

The cylindrical sleeve 16 is correspondingly sealed in the area of the outlets of the control lines 25.

After the insertion of the bridge igniter, the cavity in the sleeve 16 is minimal and, if appropriate, filled with a non-compressible medium.

Between the contacts 10 and 11 having current carrying capacity, at least one thin insulating film 18 is present.

The insulating film 18 may have an electrically conductive layer or else may be combined with an electrically conductive film.

This insulating film or these insulating films will then serve the purpose of achieving an adequate dielectric strength between the mutually opposite contacts 10; 11. The conductive coating or the additional conductive film serves to control the electric field, apart from a configuration of the surface of the contacts 10; 11 that is optimized in this respect.

The films may in this case also serve the purpose of fixing the movable cap 15 on the sleeve 16.

The movable cap 15 is realized so as to be able to bridge the distance between the contacts 10 and 11.

In this case, after the bridge igniter 17 has been activated, the cap 15 is moved toward the contact 10 and the mandrel extension 13 there by the expansion of the gas in the cavity of the sleeve 16.

During this movement, the mentioned films are pressed against the mandrel 13 and destroyed, whereby the insulation between the contacts 10 and 11 having current carrying capacity is cancelled.

To avoid any gas compression counteracting the desired movement, the mentioned deaeration openings 14 are provided.

The cap is clamped in the depression at the lower contact 11 having current carrying capacity and at the mandrel 13.

The shaft of the cap 15 remains partly within the contact 10 and bridges the distance between the two contacts 10; 11, whereby a metallic conductive connection is developed.

Basically, the mandrel 13 may also be attached to the movable cap 15, or the cap 15 may be realized with a mandrel-shaped extension.

The current carrying capacity of the electrical connection via the cap 15 described above is configured to be equal to, preferably, however, higher than the current carrying capacity of the sacrificial element 6.

The contacts 10 and 11 having current carrying capacity require exact guidance due to the discussed functional mode, which can be realized, for example, by an insulating sleeve 19 along with sealing rings 20.

In the embodiment of the switching element 3 according to FIG. 3, a similar basic construction as discussed by means of FIG. 2 is taken as a basis.

In the embodiment according to FIG. 3, however, a movably supported cap 15 is not necessary.

Rather, conductive particles 21 are present in the cavity within the sleeve 16, which generate a flashover due the gas expansion and the deaeration openings between the contacts 10 and 11 even when voltages of <70 V are applied.

In case of a corresponding metallic powder, a metallic bridge of adequate current carrying capacity may likewise be created due to the short distance between the contacts 10 and 11.

For this purpose, an adequate quantity of metal powder 21, which preferably is larger than the volume of the cavity between the electrodes 10 and 11, and only a limited ventilation with deflection through a small diameter are necessary.

After the destruction of the insulating film 18, the partly melted powder is cooled down while entering the ventilation channel 14 so severely that it solidifies and closes the passage.

The remaining powder 21 is further heated by the electric arc and forms a desired metallic bridge between the contacts 10; 11.

In this embodiment, the bridge igniter 17 itself may also be improved by a defined quantity of conductive particles.

The conductive particles in the cavity of the sleeve 16 may be mechanically fixed by a varnish layer or a film 22.

The switching elements according to the representations of FIGS. 2 and 3 are capable of realizing a low-impedance metallic connection between the main contacts 1 and 2 via the sacrificial element 6 according to FIG. 1 or 4.

The created connection has a current carrying capacity corresponding at least to that of the sacrificial element 6, ensuring in any case the triggering of the movable contact 7 and its movement for short-circuiting the main electrodes 1 and 2.

The connection via the fast switch according to the embodiments of FIGS. 2 and 3 is performed with triggering of the bridge igniter within a time of about 100 μs, which is comparable to triggering a semiconductor switch with corresponding EMV protection measures.

The auxiliary path including the fast switch 3 can be cut off after the destruction of the sacrificial element 6 by means of a fuse 4. Due to the overload resistance of the fast switch and in case of an adequate current carrying capacity of the auxiliary path, it is possible to conduct the current without interruption until the metallic short circuit of the main contacts takes place.

At an overload of the current carrying capacity of the metallic cap according to FIG. 2 or of the bridge of metallic particles 21, the fast switch functions as a spark gap having very low arc voltage. At very high loads, the contacts 10 and 11 will partially melt when an electric arc is formed, whereby a metallic short circuit in turn develops in the auxiliary path.

The auxiliary path thus can autonomously carry currents in the range of several 10 kA for some milliseconds until the relief takes place by closing the main contacts by the movable contact part. This current carrying capacity thus is higher than that of a cost-effective semiconductor switch with a comparable closing time. The costs and space requirement are reduced considerably as compared to a semiconductor switch.

The fast switching element may be provided as indicated in FIG. 1 outside of the actual short-circuiting device. Alternatively, an integration inside the short-circuiting device is also possible.

In this respect, the fast switch, apart from a complete integration into the pressure-tight housing of the short-circuiting device, may be connected, for example, by a plug-in or screwed adapter to the short-circuiting device similarly to a fuse. This allows the unit with the bridge igniter to be easily exchanged in a corresponding version even under voltage.

An exemplary representation in this respect is shown in FIG. 4. Here, the auxiliary short-circuiting device on the basis of a bridge igniter is inserted in front of the connection 5 of the sacrificial element 6. The joint to the connection 5 may be realized by a compression or plug-in joint, so that the auxiliary short-circuiting device is exchangeable. The auxiliary short-circuiting device according to FIG. 2 is introduced into the housing of the main short-circuiting device with the potential of the main contact 2 being insulated by the part 23. The joint of the auxiliary short-circuiting device to the connection 1 of the main short-circuiting device is realized via an exterior connection 24. This connection 24 may also be performed inside the housing of the main short-circuiting device if configured correspondingly.

The connections 25 for activating the auxiliary short-circuiting device to the bridge igniter 17 are lead out in an insulated manner to an acquisition unit (not illustrated) for providing the ignition power.

The invention claimed is:

1. A short-circuiting device for use in low-voltage and medium-voltage systems for the protection of property and persons, comprising a switching element (3), which can be operated by a tripping signal of a fault detection device, two mutually opposite contact electrodes (70; 80) having power supply means (1; 2), which contact electrodes can be brought into contact with an electrical circuit having connection points at different potential, furthermore a movable contact part (7), which is under mechanical preload in at least one of the contact electrodes (80) and executes a movement to the further contact electrode (70) with the assistance of spring force in the event of a short circuit, a sacrificial element (6) as a spacer between the contact electrodes (70; 80), as well as with an electrical connection between the sacrificial element (6) and the switching element (3) on the one hand and one of the contact electrodes on the other hand, in order to deliberately cause current-flow-induced thermal deformation or destruction of the sacrificial element (6), wherein the movable contact part (7) is formed as a hollow cylinder closed on one side, and in the hollow cylinder, a spring (8) is inserted for generating a preload, the hollow cylinder being guided to be movable in a complementary recess in the first contact electrode (80) while forming a sliding contact, characterized in that the switching element (3) is formed as a bridge igniter (17) composed of two mutually opposite contacts (10; 11) having current carrying capacity, which are kept at a short distance by an electrical insulation (12), wherein the electrical insulation between the contacts (10; 11) is cancelled when the bridge igniter (17) is triggered.

2. The short-circuiting device according to claim 1, characterized in that in the area of the bottom (71) of the closed hollow cylinder, its cylinder wall merges into a cone (72) on the side of the outer circumference, furthermore, a first pin-shaped extension (73) extends from the bottom in the interior of the hollow cylinder, to which extension a second pin-shaped extension (100) insulated from the contact electrodes (70; 80) is opposite, wherein between the first and the second pin-shaped extension (73; 100), the sacrificial element (6) is arranged and is formed as a bolt or screw, and within the second contact electrode (80), a recess with an inner cone (91) is provided, which recess is adapted to the outer cone (72) of the movable contact (7), wherein the outer and inner cones form a bounce-free short circuit contact area with frictional and positive connection due to the occurring plastic deformation.

3. The short-circuiting device according to claim 2, characterized in that deaeration openings (92) connected to the area of the recess with the inner cone are provided in the second contact electrode (70) in order to prevent pressure from building up due to the movement of the contact part (7).

4. The short-circuiting device according to claim 3, characterized in that the deaeration openings (92) are closed by a plug displacing under the effect of pressure, or by a valve.

5. The short-circuiting device according to claim 1, characterized in that a clearance dimension of the sliding contact is <0.2 mm.

6. The short-circuiting device according to claim 2, characterized in that a respective cone angle is in the range of ≤3°.

7. The short-circuiting device according to claim 1, characterized in that the contact electrodes (70; 80) are formed to be rotationally symmetrical and kept at a distance via an insulating centering ring (110).

8. The short-circuiting device according to claim 2, characterized in that the movable contact part (7) moves like a piston in the recess of the first contact electrode (80), with the energy released during the destruction of the sacrificial element (6) and/or the energy of a developing arc acting upon the bottom (71) of the movable contact part (7) in a movement accelerating manner.

9. The short-circuiting device according to claim 2, characterized in that the second pin-shaped extension (100) is surrounded by an insulating tube of a gas-emitting material.

10. The short-circuiting device according to claim 1, characterized in that one of the contacts (11) having current carrying capacity includes a depression in which a mandrel extension (13) is formed, whose tip points toward a film (18) spanning the depression.

11. The short-circuiting device according to claim 10, characterized in that the further one of the contacts (10) having current carrying capacity includes a cavity for the bridge igniter (17).

12. The short-circuiting device according to claim 11, characterized in that a pressure-tight sleeve (16) is located in the cavity.

13. The short-circuiting device according to claim 12, characterized in that the sleeve (16) includes a cap (17) in the direction of the mandrel extension (13), which cap, when the bridge igniter (17) is triggered, moves toward the mandrel extension (13) while destroying the film (18) and establishing an electrical connection between the contacts (10; 11) having current carrying capacity.

14. The short-circuiting device according to claim 10, characterized in that the depression includes a deaeration opening (14).

15. The short-circuiting device according to claim 10, characterized in that conductive particles (21) are introduced into the cavity of the sleeve (16), which, when the bridge igniter (17) is triggered, establish an electrical connection between the contacts (10; 11).

16. The short-circuiting device according to claim 15, characterized in that, on the side of the sleeve opening, the conductive particles (21) are fixed by means of a film or a cover layer (22).

17. The short-circuiting device according to claim 1, characterized in that the switching element can be integrated into the contact electrode (80) along with the bridge igniter (17).

18. The short-circuiting device according to claim 17, characterized in that the switching element can be screwed in or plugged in.

* * * * *